US011396832B2

(12) United States Patent
Nemoto et al.

(10) Patent No.: US 11,396,832 B2
(45) Date of Patent: Jul. 26, 2022

(54) VALVE TIMING ADJUSTING DEVICE

(71) Applicant: DENSO CORPORATION, Kariya (JP)

(72) Inventors: Kazuaki Nemoto, Kariya (JP); Akio Imai, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/226,409

(22) Filed: Apr. 9, 2021

(65) Prior Publication Data

US 2021/0222593 A1 Jul. 22, 2021

Related U.S. Application Data

(63) Continuation of application No. PCT/JP2019/039872, filed on Oct. 9, 2019.

(30) Foreign Application Priority Data

Oct. 11, 2018 (JP) ..... JP2018-192791

(51) Int. Cl.

| | |
|---|---|
| ***F01L 1/34*** | (2006.01) |
| ***F01L 9/22*** | (2021.01) |
| ***F01L 9/40*** | (2021.01) |
| ***F01L 1/344*** | (2006.01) |

(52) U.S. Cl.

CPC ..... *F01L 9/22* (2021.01); *F01L 1/344* (2013.01); *F01L 9/40* (2021.01); *F01L 2820/01* (2013.01); *F01L 2820/031* (2013.01); *F01L 2820/032* (2013.01)

(58) Field of Classification Search

CPC ..... F01L 9/22; F01L 9/40; F01L 1/344; F01L 2820/01; F01L 2820/031; F01L 2820/032; F01L 2820/02; F01L 2820/12; F01L 2250/02; F01L 2001/0537; F01L 2001/34496

See application file for complete search history.

(56) References Cited

U.S. PATENT DOCUMENTS

| | | | | |
|---|---|---|---|---|
| 2002/0121253 | A1 | 9/2002 | Hase | |
| 2007/0245986 | A1* | 10/2007 | Fujii | F01M 9/10 123/90.16 |
| 2009/0121671 | A1 | 5/2009 | Uehama et al. | |

(Continued)

FOREIGN PATENT DOCUMENTS

| | | |
|---|---|---|
| JP | 10-030463 | 2/1998 |
| JP | 11-229828 | 8/1999 |

*Primary Examiner* — Zelalem Eshete

(74) *Attorney, Agent, or Firm* — Nixon & Vanderhye P.C.

(57) ABSTRACT

A valve timing adjusting device includes an intake variable valve mechanism and an exhaust variable valve mechanism. The exhaust variable valve mechanism includes an exhaust electric driving portion and an exhaust phase shifting portion including an input shaft. The exhaust phase shifting portion is disposed in a rotation transmission path between an exhaust camshaft and a crankshaft and configured to shift a rotation phase of the exhaust camshaft. The input shaft rotates in a rotational direction opposite to a rotational direction of the crankshaft when advancing the rotation phase. A phase of the exhaust phase shifting portion is configured to be shifted to a most advanced angle phase when the exhaust electric driving portion is de-energized or fails and when the exhaust phase shifting portion receives a torque in a forward rotational direction.

6 Claims, 4 Drawing Sheets

(56) References Cited

U.S. PATENT DOCUMENTS

| | | | | |
|---|---|---|---|---|
| 2014/0216372 | A1 | 8/2014 | Tadokoro et al. | |
| 2014/0245978 | A1 | 9/2014 | Tadokoro et al. | |
| 2015/0090210 | A1* | 4/2015 | Sugiura ..... | F01L 1/022<br>123/90.34 |

* cited by examiner

VALVE TIMING ADJUSTING DEVICE

CROSS REFERENCE TO RELATED APPLICATION

The present application is a continuation application of International Patent Application No. PCT/JP2019/039872 filed on Oct. 9, 2019, which designated the U.S. and claims the benefit of priority from Japanese Patent Application No. 2018-192791 filed on Oct. 11, 2018. The entire disclosures of all of the above applications are incorporated herein by reference.

TECHNICAL FIELD

The present disclosure relates to a valve timing adjusting device.

BACKGROUND ART

A valve timing adjusting device has variable valve mechanisms at both of an intake valve and an exhaust valve. There are two types of drive system for the variable valve mechanism: hydraulic type and electric type.

SUMMARY

A valve timing adjusting device of the present disclosure includes an intake variable valve mechanism and an exhaust variable valve mechanism. The intake variable valve mechanism is configured to vary a valve timing of an intake valve of an internal combustion engine. The exhaust variable valve mechanism is configured to vary a valve timing of an exhaust valve of the internal combustion engine. The exhaust variable valve mechanism includes an exhaust electric driving portion and an exhaust phase shifting portion disposed in a rotation transmission path between a crankshaft of the internal combustion engine and an exhaust camshaft. The exhaust phase shifting portion includes an input shaft connected to the exhaust electric driving portion and is configured to shift a rotation phase of the exhaust camshaft relative to the crankshaft by reducing a speed of a rotation of the input shaft. The input shaft rotates in a rotational direction opposite to a rotational direction of the crankshaft when advancing the rotation phase.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Figure 1:
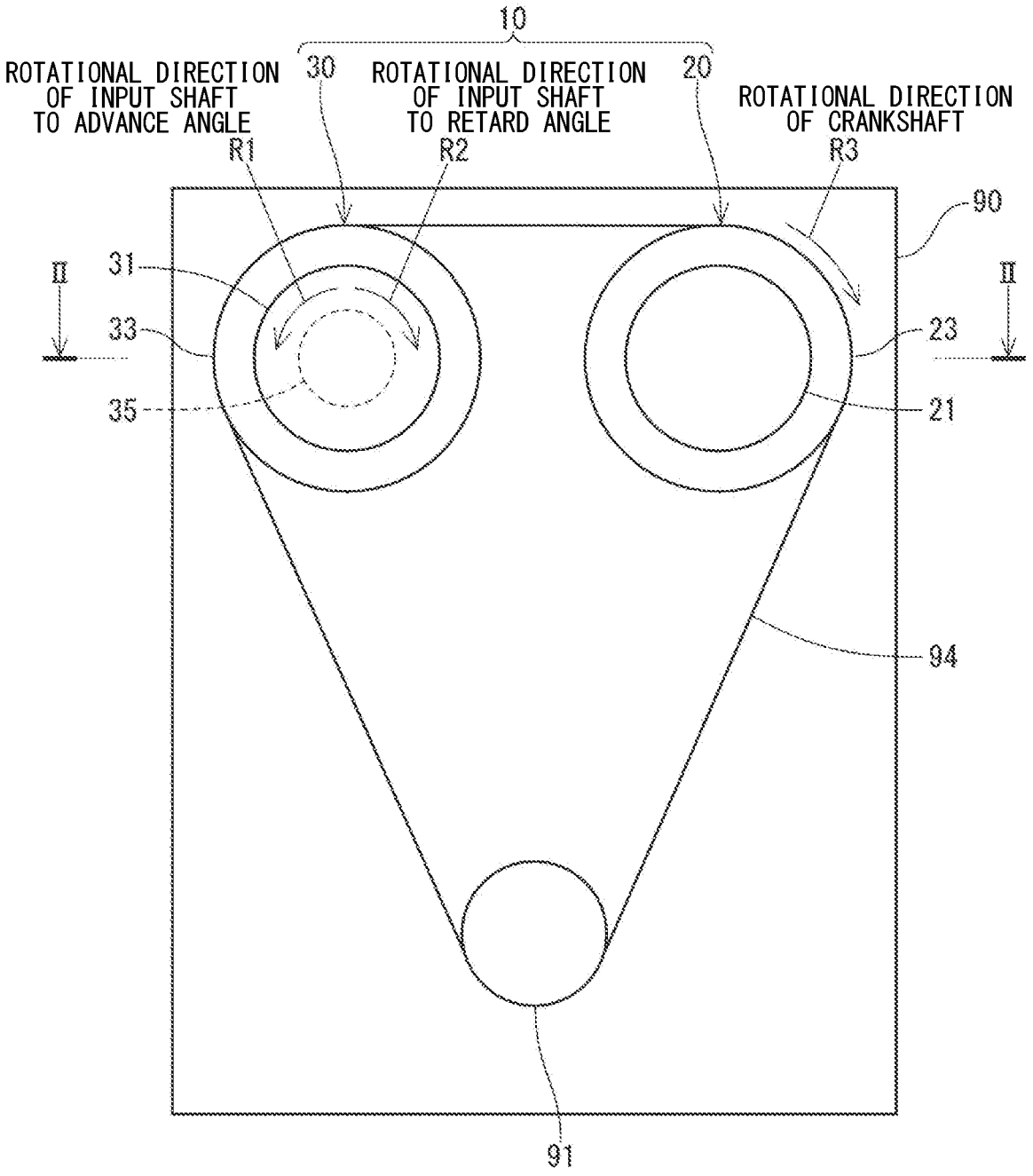
FIG. 1 is a schematic view of an internal combustion engine to which a valve timing adjusting device of a first embodiment is applied.

To begin with, examples of relevant techniques will be described.

A valve timing adjusting device has variable valve mechanisms at both of an intake valve and an exhaust valve. There are two types of drive system for the variable valve mechanism: hydraulic type and electric type. An electric variable valve mechanism is applied for the exhaust valve.

Normally, a default phase of the exhaust variable valve mechanism is the most advanced phase. However, the electric exhaust variable valve mechanism is not biased in an advance angle direction by a force such as a spring force. Thus, when the energization is cut or stopped by a failure and when the variable valve mechanism receives a positive torque, a phase of the variable valve mechanism may be shifted in a retard angle direction. In this case, the valve overlap becomes large and a ratio of fresh air in an intake air becomes low, which leads to insufficient torque and may make an internal combustion unable to start.

The present disclosure has been made in view of the above points and it is objective of the present disclosure to provide a valve timing adjusting device that can secure an engine startability.

A valve timing adjusting device of the present disclosure includes an intake variable valve mechanism and an exhaust variable valve mechanism. The intake variable valve mechanism is configured to vary a valve timing of an intake valve of an internal combustion engine. The exhaust variable valve mechanism is configured to vary a valve timing of an exhaust valve of the internal combustion engine. The exhaust variable valve mechanism includes an exhaust electric driving portion and an exhaust phase shifting portion disposed in a rotation transmission path between a crankshaft of the internal combustion engine and an exhaust camshaft. The exhaust phase shifting portion includes an input shaft connected to the exhaust electric driving portion and is configured to shift a rotation phase of the exhaust camshaft relative to the crankshaft by reducing a speed of a rotation of the input shaft. The input shaft rotates in a rotational direction opposite to a rotational direction of the crankshaft when advancing the rotation phase.

According to this, when the electric driving portion is de-energized or fails, a phase of the exhaust phase shifting portion is automatically shifted to the most advanced angle phase. That is, the phase of the exhaust phase shifting portion is automatically returned to the default phase. This phase shift to the most advanced angle phase and keeping the most advanced angle phase can be achieved without using a phase rock mechanism or a biasing spring. Therefore, it is possible to prevent a decrease in the ratio of fresh air to the intake air due to excessive valve overlap, so that engine startability can be ensured.

Hereinafter, multiple embodiments of a valve timing adjusting device will be described with reference to the drawings. In the embodiments, substantially the same components are denoted by the same reference numerals and description thereof is omitted.

First Embodiment

Figure 2:
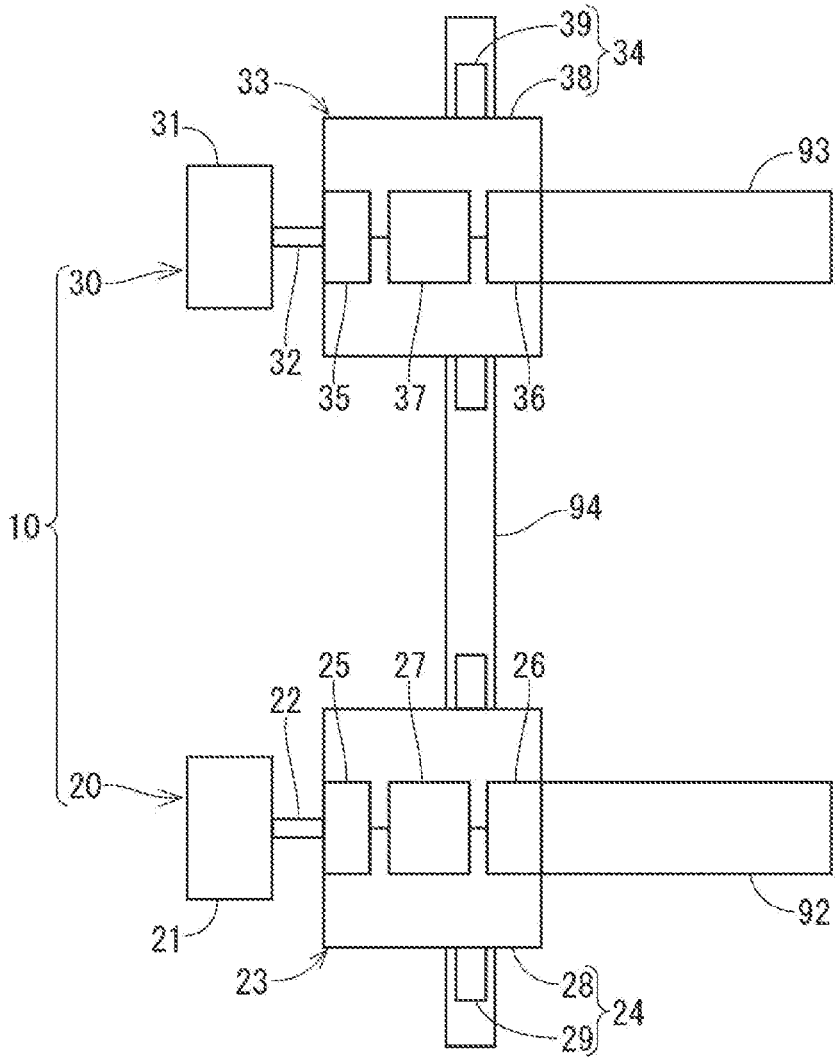
FIG. 2 is a schematic cross-sectional view of the valve timing adjusting device taken along a line II-II in FIG. 1.

As shown in FIGS. 1 and 2, a valve timing adjusting device of a first embodiment is disposed in a rotation transmission path between a crankshaft 91 of an internal combustion engine 90 and camshafts 92 and 93. The valve timing adjusting device is configured to adjust valve timings of an intake valve and an exhaust valve (not shown). The valve timing adjusting device 10 includes an intake variable valve mechanism 20 and an exhaust variable valve mechanism 30.

The exhaust variable valve mechanism 30 includes an electric motor 31 and a phase shifting portion 33. The electric motor 31 is an electric driving portion and configured to output a rotational force from a motor shaft 32 when being energized.

The phase shifting portion 33 includes a driving rotating member 34, an input shaft 35, a driven rotating member 36, and a reduction mechanism 37. The driving rotating member 34 includes a housing 38 and a sprocket 39 disposed outside of the housing 38. The sprocket 39 is connected to the crankshaft 91 through a chain 94. The driving rotating member 34 is configured to rotate in conjunction with the crankshaft 91.

The input shaft 35, the driven rotating member 36, and the reduction mechanism 37 are disposed in the housing 38. The input shaft 35 is connected to the motor shaft 32. The driven rotating member 36 is fastened to the exhaust camshaft 93.

The reduction mechanism 37 is disposed between the housing 38 and the driven rotating member 36 and configured to transmit a rotation between the housing 38 and the driven rotating member 36. When the internal combustion engine 90 drives and the crankshaft 91 rotates, the rotational force of the crankshaft 91 is transmitted to the driving rotating member 34 through the chain 94. The rotational force of the driving rotating member 34 is transmitted to the exhaust camshaft 93 through the reduction mechanism 37 and the driven rotating member 36. Thereby, a cam of the exhaust camshaft 93 selectively opens and closes the exhaust valve.

The reduction mechanism 37 is configured to reduce a rotational speed of the input shaft 35 and transmit a rotation of the input shaft 35 to the driven rotating member 36. When the rotational force of the input shaft 35 rotates the driven rotating member 36 in a reverse direction relative to the driving rotating member 34, a relative rotation phase of the exhaust camshaft 93 relative to the crankshaft 91 is shifted. Hereinafter, the relative rotation phase of the exhaust camshaft 93 relative to the crankshaft 91 is simply referred to as a rotation phase. The phase shifting portion 33 is configured to shift the rotation phase by reducing a rotational speed of the input shaft 35 and transmit the rotation of the input shaft 35 to the exhaust camshaft 93.

When the driven rotating member 36 relatively rotates in a forward direction (i.e., an engine rotating direction) relative to the driving rotating member 34, an opening/closing timing of the exhaust valve is advanced. When the driven rotating member 36 relatively rotates in a reverse direction (i.e., a reverse direction to the engine rotating direction) relative to the driving rotating member 34, the opening/closing timing of the exhaust valve is retarded. A relative rotation range of the driven rotating member 36 is restricted between the most advanced angle position and the most retarded angle position by the reduction mechanism 37. The most advanced angle phase is defined as a rotation phase corresponding to the most advanced angle position. The most retarded angle phase is defined as a rotation phase corresponding to the most retarded angle position.

The intake variable valve mechanism 20 has a similar configuration to that of the exhaust variable valve mechanism 30 except for the following features. That is, the intake variable valve mechanism 20 includes, as components corresponding to a configuration of the intake variable valve mechanism 20, an electric motor 21, a motor shaft 22, a phase shifting portion 23, a driving rotating member 24, an input shaft 25, a driven rotating member 26, a reduction mechanism 27, a housing 28, and a sprocket 29.

As shown in FIG. 1, a rotational direction R1 of the input shaft 35 to advance the rotation phase is a reverse direction to a rotational direction R3 of the crankshaft 91 (i.e., the engine rotational direction). A rotational direction R2 of the input shaft 35 to retard the rotation phase is the same as the rotational direction R3 of the crankshaft 91. When a reduction ratio of the reduction mechanism 37 is defined as A, $A<0$.

In the first embodiment, the reduction ratio of the intake phase shifting portion 23 and the reduction ratio of the exhaust phase shifting portion 33 have opposite signs. That is, when the reduction ratio of the reduction mechanism 27 is defined as B, $A<0$ and $B>0$.

In the first embodiment, a product $(Tm\times|A|)$ of an average torque Tm of the motor shaft 32 of the electric motor 31 when de-energized and an absolute value of the reduction ratio A of the phase shifting portion 33 is greater than a difference $(Tc-Tv)$ between an average torque Tc of the exhaust camshaft 93 and an average friction torque Tv of the phase shifting portion 33. That is, $(Tm\times|A|)>(Tc-Tv)$.

(Advantages)

As described above, in the first embodiment, the rotational direction R1 of the input shaft 35 is opposite to the rotational direction R3 of the crankshaft 91 when advancing the rotation phase. As a result, when the electric motor 31 is de-energized or fails, the phase of the exhaust phase shifting portion 33 is automatically shifted to the most advanced angle phase. That is, the phase of the phase shifting portion is automatically shifted to the default phase. This phase shift to the most advanced angle phase and keeping the most advanced angle phase can be achieved without using a phase rock mechanism or a biasing spring. Therefore, it is possible to prevent a decrease in the ratio of fresh air to the intake air due to excessive valve overlap, so that engine startability can be ensured.

Further, in the first embodiment, the reduction ratio of the intake phase shifting portion 23 and the reduction ratio of the exhaust phase shifting portion 33 have opposite signs. Thus, the default phase of the exhaust phase shifting portion 33 is set to the most advanced angle phase and the default phase of the intake phase shifting portion 23 is set to the most retarded angle phase.

Further, in the first embodiment, a product $(Tm\times|A|)$ of the average torque Tm and the absolute value $|A|$ of the reduction ratio A is larger than a difference $(Tc-Tv)$ between the average torque Tc and the average friction torque Tv. Therefore, when the energization to the electric motor 31 is cut or the electric motor 31 fails, the phase of the phase shifting portion 33 is surely shifted to the most advanced angle phase by the friction torque of the electric motor 31.

Second Embodiment

Figure 3:
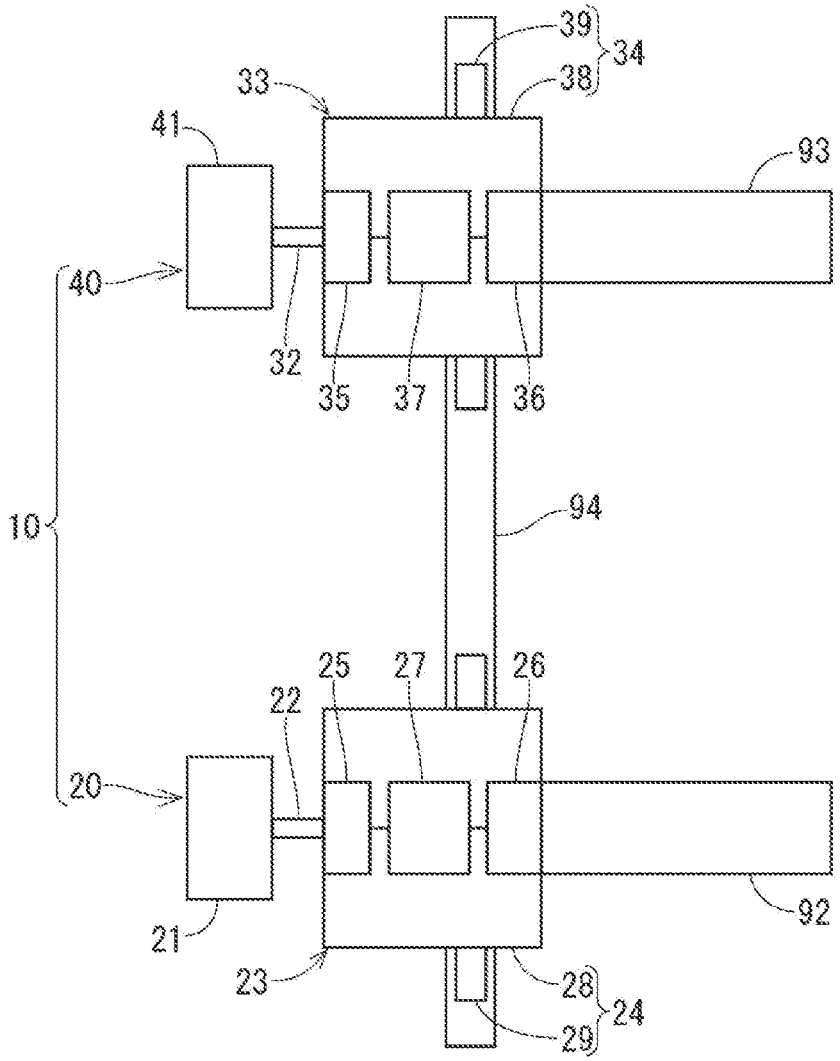
FIG. 3 is a schematic view of a valve timing adjusting device of a second embodiment.

In a second embodiment, as shown in FIG. 3, the electric driving portion of the exhaust variable valve mechanism 40 is configured with an electromagnetic actuator 41 such as an electromagnetic clutch. The reduction mechanism 37 is driven by the electromagnetic actuator 41. As described above, the electric driving portion may be the electromagnetic actuator 41. Also in this way, the phase of the exhaust phase shifting portion 33 is automatically shifted to the most advanced angle phase when the energization is cut or stopped by a failure, and similar advantages to those of the first embodiment can be obtained.

Other Embodiments

In other embodiments, the drive system of the intake variable valve mechanism is not limited to the electric system and may be a hydraulic system or the like.

Reference Embodiment

Figure 4:
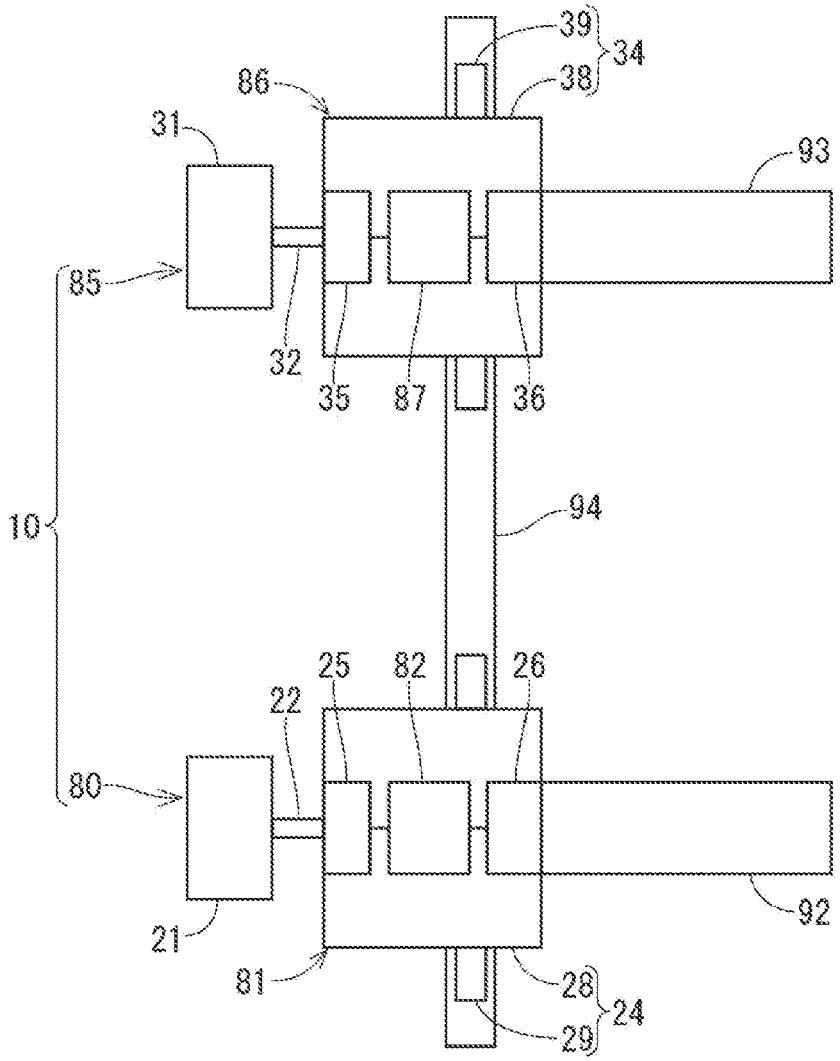
FIG. 4 is a schematic view of a valve timing adjusting device of a reference embodiment.

In a reference embodiment shown in FIG. 4, a phase shifting portion 81 of an intake variable valve mechanism 80 includes a reduction mechanism 82. A phase shifting portion of an exhaust variable valve mechanism 85 includes a reduction mechanism 87. The reduction ratio of the intake phase shifting portion 81 and the reduction ratio of the exhaust phase shifting portion 86 have opposite signs and $A>0$ and $B<0$.

The present disclosure has been described, based on the embodiments. However, the present disclosure is not limited to the embodiments and the structures. The present disclosure also includes various modification examples and modifications within the scope of equivalents. Furthermore, various combination and formation, and other combination and formation including one, more than one or less than one element may be made in the present disclosure.

What is claimed is:

1. A valve timing adjusting device comprising:

an intake variable valve mechanism configured to vary a valve timing of an intake valve of an internal combustion engine; and an exhaust variable valve mechanism configured to vary a valve timing of an exhaust valve of the internal combustion engine, wherein the exhaust variable valve mechanism includes:

an exhaust electric driving portion; and an exhaust phase shifting portion including an input shaft connected to the exhaust electric driving portion, the exhaust phase shifting portion being disposed in a rotation transmission path between an exhaust camshaft and a crankshaft of the internal combustion engine, the exhaust phase shifting portion being configured to shift a rotation phase of the exhaust camshaft relative to the crankshaft by reducing a speed of a rotation of the input shaft and transmitting the rotation of the input shaft to the exhaust camshaft, the input shaft rotates in a rotational direction opposite to a rotational direction of the crankshaft when advancing the rotation phase, and a phase of the exhaust phase shifting portion is configured to be a most advanced angle phase when the exhaust electric driving portion is de-energized or fails and when the exhaust phase shifting portion receives a torque in a forward rotational direction, the exhaust phase shifting portion further includes a reduction mechanism configured to reduce the speed of the rotation of the input shaft and to transmit the rotation of the input shaft toward the exhaust camshaft, the intake variable valve mechanism includes:

an intake electric driving portion; and an intake phase shifting portion disposed in a rotation transmission path between the crankshaft and an intake camshaft, the intake phase shifting portion being configured to shift a rotation phase of the intake camshaft relative to the crankshaft by reducing a speed of a rotation output by the intake electric driving portion and transmitting the rotation to the intake camshaft, the intake phase shifting portion includes a reduction mechanism configured to reduce the speed of the rotation output by the intake electric driving portion and to transmit the rotation toward the intake camshaft, and a reduction ratio of the reduction mechanism of the intake phase shifting portion and a reduction ratio of the reduction mechanism of the exhaust phase shifting portion have opposite signs.

2. The valve timing adjusting device according to claim 1, wherein the exhaust electric driving portion is an electric motor.

3. The valve timing adjusting device according to claim 1, wherein the exhaust electric driving portion is an electromagnetic actuator.

4. The valve timing adjusting device according to claim 2, wherein a product of an average torque of a motor shaft of the electric motor when de-energized and an absolute value of a reduction ratio of the exhaust phase shifting portion is greater than a difference between an average torque of the exhaust camshaft and an average friction torque of the exhaust phase shifting portion.

5. A valve timing adjusting device comprising:

an intake variable valve mechanism configured to vary a valve timing of an intake valve of an internal combustion engine; and an exhaust variable valve mechanism configured to vary a valve timing of an exhaust valve of the internal combustion engine, wherein the exhaust variable valve mechanism includes:

an exhaust electric driving portion; and an exhaust phase shifting portion including an input shaft connected to the exhaust electric driving portion, the exhaust phase shifting portion being disposed in a rotation transmission path between an exhaust camshaft and a crankshaft of the internal combustion engine, the exhaust phase shifting portion being configured to shift a rotation phase of the exhaust camshaft relative to the crankshaft by reducing a speed of a rotation of the input shaft and transmitting the rotation of the input shaft to the exhaust camshaft, the input shaft rotates in a rotational direction opposite to a rotational direction of the crankshaft when advancing the rotation phase;

a phase of the exhaust phase shifting portion is configured to be a most advanced angle phase when the exhaust electric driving portion is de-energized or fails and when the exhaust phase shifting portion receives a torque in a forward rotational direction;

the exhaust electric driving portion is an electric motor; and a product of an average torque of a motor shaft of the electric motor when de-energized and an absolute value of a reduction ratio of the exhaust phase shifting portion is greater than a difference between an average torque of the exhaust camshaft and an average friction torque of the exhaust phase shifting portion.

6. The valve timing adjusting device according to claim 1, wherein a phase of the intake phase shifting portion is configured to be set to a most retarded angle phase when the intake electric driving portion is de-energized or fails.

* * * * *